US005406785A

United States Patent [19]

Andersson et al.

[11] Patent Number: 5,406,785

[45] Date of Patent: Apr. 18, 1995

[54] METHOD AND A DEVICE IN A PFBC POWER PLANT

[75] Inventors: Mats Andersson; John Weatherby, both of Finspong, Sweden

[73] Assignee: ABB Carbon AB, Finspong, Switzerland

[21] Appl. No.: 167,945

[22] PCT Filed: Jun. 15, 1992

[86] PCT No.: PCT/SE92/00425

§ 371 Date: Dec. 20, 1993

§ 102(e) Date: Dec. 20, 1993

[87] PCT Pub. No.: WO93/00554

PCT Pub. Date: Jul. 7, 1993

[30] Foreign Application Priority Data

Jun. 20, 1991 [SE] Sweden ..... 9101901

[51] Int. Cl.[6] ..... F02C 3/26

[52] U.S. Cl. ..... 60/39.03; 60/39.464; 122/4

[58] Field of Search ..... 60/39.02, 39.03, 39.182, 60/39.464; 122/4

[56] References Cited

U.S. PATENT DOCUMENTS 3,659,559 5/1972 Foldes et al. ..... 122/4 D
3,863,606 2/1975 Bryers et al. ..... 122/4 D
4,380,147 4/1983 Zaba ..... 60/39.464
4,793,292 12/1988 Engstrom et al. .
4,896,497 1/1990 Pillai .
5,022,893 6/1991 Abdulally .

FOREIGN PATENT DOCUMENTS 01085055 5/1984 European Pat. Off. .
88/04010 11/1987 WIPO .

*Primary Examiner*—Louis J. Casaregola
*Attorney, Agent, or Firm*—Pollock, Vande Sande & Priddy

[57] ABSTRACT

A method and device for maintaining a high gas temperature to a gas turbine in a partial-load operation of a PFBC power plant, wherein gas is normally fed out from a fluidized bed through at least one central channel in a combustor which combustor also includes tubes for cooling the bed and for generating steam, tubes normally being completely accommodated in the bed, and during partial-load operation of the plant upper portions of the tubes being exposed above the surface of the bed, wherein during partial-load operation of the plant at least part of the combustion gases is discharged from the combustor via at least one side channel positioned substantially at least at one side of the exposed tube portions, these tube portions thus being completely or partly bypassed by the combustion gases.

9 Claims, 1 Drawing Sheet

METHOD AND A DEVICE IN A PFBC POWER PLANT

TECHNICAL FIELD

The present invention relates to a method and a device for maintaining a high gas temperature to a gas turbine in connection with partial-load operation of a PFBC plant, in which gas is fed out from a fluidizable bed in a combustor which also includes tubes for generating steam, the tubes being completely or partially covered by the fluidized bed in dependence on the degree of load.

BACKGROUND OF THE INVENTION

In operation of a PFBC (Pressurized Fluidized Bed Combustion) plant, a varying part of the tubes which are to generate steam for a steam turbine in the plant will be covered by the fluidized bed in dependence on the degree of load. In case of full-load operation, the tubes are completely covered, and in case of partial-load operation they are partially covered. One problem in this connection is that the non-covered tube portions cool the combustion gases which leave the bed at a temperature of about 850° C. A reduced temperature of the gases to the gas turbine entails, among other things, a deteriorated efficiency of the plant, favorable conditions for $NO_x$ reduction, and an increased CO content in the waste gases from the plant.

SUMMARY OF THE INVENTION

The present aims to provide a solution to the above-mentioned problems and other problems associated therewith and is characterized in than hot combustion gases are discharged from outlets located at different levels in the combustor in dependence on the degree of partial load. By discharging combustion gas via outlets at different levels, outlets at lower levels during low-load operation and outlets at higher levels during high-load operation, the cooling of the combustion gases due to the cooling effect of exposed tube is reduced. By means of this device the waste gas temperature can be maintained at the desired, high value.

BRIEF DESCRIPTION OF THE DRAWING

The invention will be exemplified with reference to the accompanying figures, wherein.

DESCRIPTION OF THE PREFERRED EMBODIMENTS

Figure 1:
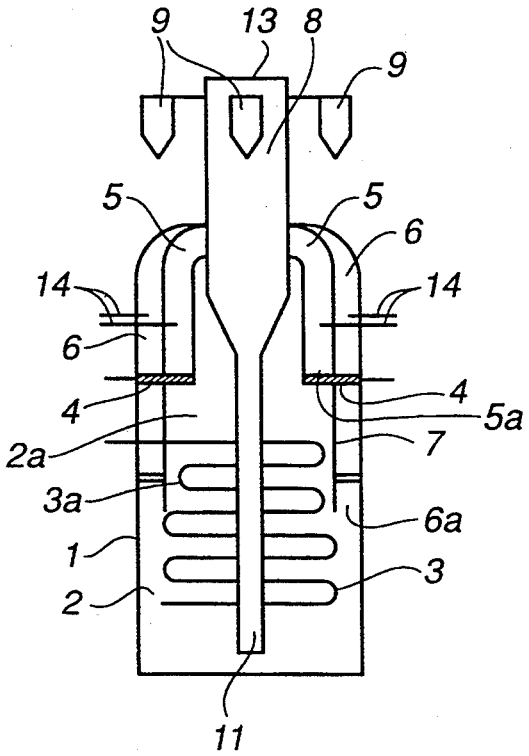
FIG. 1 is a view showing the principle of a PFBC power plant according to the present invention.
Figure 2:
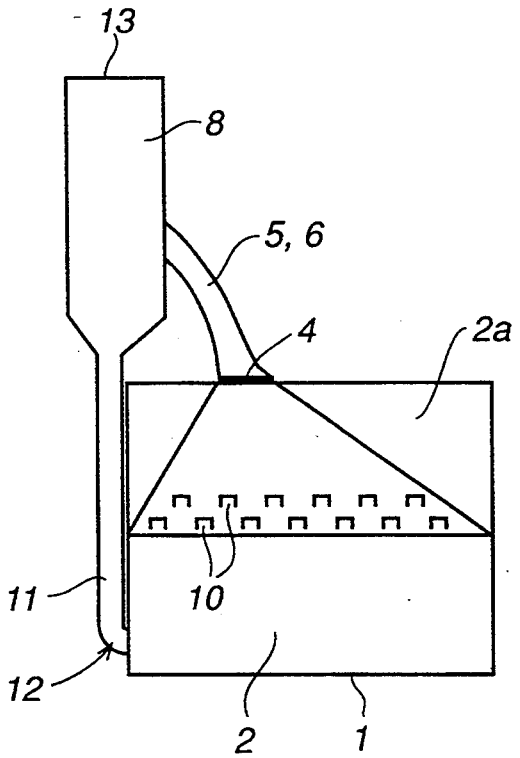
FIG. 2 is a side view of the same plant.

FIGS. 1 and 2 show a combustor 1 for a PFBC power plant, wherein the combustor 1 comprises a fluidizable bed 2 of a known kind, see for example, EP108 505. This bed 2 accomodates tubes 3 for cooling the bed 2, which generate steam for steam turbines. In operation of the plant, in case of full load, the tubes 3 are normally fully covered by the fluidized bed 2. The combustion gases leaving the bed 2 to a freeboard 2*a* above the bed surface, have a high temperature, preferably 850° C. In partial-load operation of the plant, the bed level is lowered, parts of the tubes 3 thus being exposed such that portions of the tubes 3, tube portions 3*a*, will be located above the surface of the bed 2.

Valve members 4 are arranged at the upper part of the combustion chamber in the combustor 1. For discharging combustion gases, two separate flue gas channels are provided. These consist primarily of a centrally arranged flue gas channel, a central channel 5, which may, and is suitably designed as several channels separated from each other. The central channel 5 is provided with a higher outlet 5*a* for flue gases from the freeboard 2*a*, which outlet 5*a* is located at a higher level in the combustor 1 than the tube portions 3*a*. Other channels for flue gases, side channels 6, are arranged adjacent to the walls of the combustor 1. These side channels 6 are provided at their lower part with lower outlets 6*a* for flue gases from the freeboard 2*a*, which lower outlets 6*a* are located at a lower level in the combustor 1 than the outlets 5*a*, namely at the side of the upper tube portions 3*a*. This means that the flue gases which are forced out from the combustor 1 via the side channels 6 do not pass the tube portions 3*a* to any major extent and consequently are not cooled by these tube portions 3*a*.

In full-load operation, the valve members 4 are arranged such that the central channel 5 is open and the side channels 6 closed, which means that the flue gases which leave the bed surface, which in case of full load is located at a higher level than the tube portions 3*a*, are passed out via the higher outlet 5*a* to the central channel 5.

In partial-load operation, the surface of the fluidized bed 2 is lowered, whereby tube portions 3*a* are exposed and will be positioned above the bed surface of the freeboard 2*a*. The valve members 4 are adjusted such that the central channel 5 is closed completely or partially in dependence on the degree of partial load, while at the same time the side channels 6 are opened completely or partially to a corresponding extent, in dependence on the degree of partial load, the whole or part of the flue gas flow thus being discharged from the combustor 1 at the side of the tube portions 3*a* via the lower outlets 6*a* to the side channels 6. In this way, the flue gases are passed out at the side of the tube portions 3*a*, the cooling from these tube portions 3*a* thus being reduced or completely stopped.

A double set of central channels 5 and side channels 6, one channel of each type being located along the long sides of the combustor 1, is used in the embodiment shown in FIG. 1 in a version of a combustor 1 having rectangular cross section. Between the central channel 5 and the side channel 6 a partition 7 is arranged.

The tube portions 3*a* cover a smaller area of the horizontal cross section area of the combustor 1 than that cross section area which is occupied by the other tubes 3 in the entire set of steam tubes in the bed 2.

At certain partial-load levels between low-load operation and full-load operation of the plant, flue gases are removed both via the central channel 5 and via the side channels 6. Such operating modes occur where this is advantageous because of the limitations imposed on the gas turbine.

Both central channels 5 and side channels 6 open out into one (or more) coarse cleaner cyclones 8, in which dust is separated from the flue gases and removed via the cyclone leg 11. Dust from the cyclone leg 11 is returned to the bed, for example via a so-called L-valve 12, by means of which dust is injected into the bed 2. Cleaned flue gases are discharged from the cyclone 8 at outlets positioned in the uppermost section 13 of the cyclone.

In the gas paths of the flue gas channels 5, 6 in, there are arranged beams, such as U-beams 10, suitably formed into a labyrinth to perform a coarse cleaning of the waste gases, coarser particles being captured by the labyrinth and returned to the bed. The coarse-cleaned waste gases are thereafter passed to the coarse cleaner cyclone 8.

Figure 3:
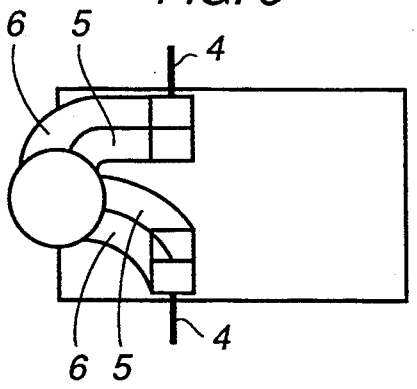
FIGS. 3 and 4 show features of the invention.

FIG. 3 illustrates an embodiment with a combustor 1 designed with rectangular cross section, indicating a proposed location of the valve members 4.

The flue gases are further cleaned by means of conventional dust separators, shown schematically in FIG. 1 in the form of cyclones 9, adjacent the flue gas outlet from the coarse cleaner cyclone 8.

Via nozzles 14 shown in FIG. 1, $NH_3$ may be injected for reducing $NO_x$ in flue gases. Sorbent for sulphur cleaning (e.g. lime) can also be injected through corresponding nozzles 14.

By adjustment of the simple valve members 4, the flow of waste gas from the bed 2 can thus be completely or partially passed by the upper tube portions 3*a*, which are exposed during partial-load operation, to the coarse cleaner cyclone 8. This coarse cleaner cyclone 8 returns more or less unburnt dust/ashes emanating from the bed 2 to the bed via the cyclone leg 11.

Figure 4:
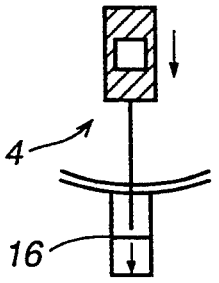

FIG. 4 illustrates how the valve member 4 is controlled from a drive member 16 positioned outside a partially shown pressure vessel wall in the pressure vessel which surrounds the combustor 1.

The method and the device according to the above can be varied in many ways within the scope of the following claims.

We claim:

1. A method of maintaining a high gas temperature to a gas turbine in a partial-load operation of a PFBC power plant, wherein gas is normally fed out from a fluidized bed through at least one central channel in a combustor which combustor also includes tubes for cooling the bed and for generating steam, said tubes normally being completely accommodated in the bed, and during partial-load operation of the plant upper portions of the tubes being exposed above the surface of the bed, wherein during partial-load operation of the plant at least part of the combustion gases is discharged from the combustor via at least one side channel positioned substantially at least at one side of the exposed tube portions, these tube portions thus being completely or partly bypassed by the combustion gases.

2. A method according to claim 1, wherein at a high bed height, during full-load operation of the plant, the gases are discharged via outlets located at a higher level in the combustor than the exposed tube portions.

3. A method according to claim 1, wherein the combustion gases are coarse-cleaned in a labyrinth of U-beams before they leave the combustor.

4. A method according to claim 3, wherein particles from the combustion gases, which are separated during the coarse cleaning, are returned to the fluidized bed.

5. A method according to claim 1, wherein the outlets and the distribution of the flue gas flow to said central channels and said side channels, respectively, are controlled by valve members.

6. A device for maintaining a high gas temperature to a gas turbine during partial-load operation of a PFBC power plant, wherein gas is fed out from a fluidized bed in a combustor which also includes tubes for cooling the bed and for generating steam, said tubes normally being completely accommodated in the bed, and during partial-load operation of the plant upper portions of the tubes being exposed above the surface of the bed, said device including outlets arranged at different levels of the combustor for discharging gas from the combustor, wherein lower outlets for flue gases are arranged at the side of the exposed upper tube portions, whereas higher outlets are arranged at a level higher than the highest possible surface of the bed.

7. A device according to claim 6, further including valve members arranged for opening and closing, respectively, completely or partially, the different gas outlets.

8. A device according to claim 6, further including central gas channels provided with said higher outlets and side gas channels provided with said lower outlets, and wherein said gas channels open out into at least one coarse cleaner cyclone.

9. A device according to claim 8, wherein the coarse cleaner cyclone, or the cyclone leg thereof, is connected to the bed space.

* * * * *

UNITED STATES PATENT AND TRADEMARK OFFICE

CERTIFICATE OF CORRECTION

PATENT NO. : 5,406,785
DATED : April 18, 1995
INVENTOR(S) : Mats Andersson and John Weatherby It is certified that error appears in the above-indentified patent and that said Letters Patent is hereby corrected as shown below:

On the title page of the patent at 73 change "ABB Carbon AB, Finspong, Switzerland" to --ABB Carbon AB, Finspong, Sweden--.

Signed and Sealed this

Fourth Day of July, 1995

Bruce Lehman

*Attest:*

BRUCE LEHMAN

*Attesting Officer*

*Commissioner of Patents and Trademarks*